United States Patent [19]

Seyb, Jr. et al.

[11] Patent Number: 4,543,167

[45] Date of Patent: Sep. 24, 1985

[54] CONTROL OF ANODE GAS EVOLUTION IN TRIVALENT CHROMIUM PLATING BATH

[75] Inventors: Edgar J. Seyb, Jr., Freehold; Laurence A. Brown, Carteret, both of N.J.

[73] Assignee: M&T Chemicals Inc., Woodbridge, N.J.

[21] Appl. No.: 576,778

[22] Filed: Feb. 3, 1984

Related U.S. Application Data

[63] Continuation of Ser. No. 354,999, Mar. 5, 1982, abandoned.

[51] Int. Cl.[4] ..... C25D 3/06

[52] U.S. Cl. ..... 204/51

[58] Field of Search ..... 204/51

[56] References Cited

U.S. PATENT DOCUMENTS

| | | | |
|---|---|---|---|
| 3,706,638 | 12/1972 | Bride | 204/51 |
| 3,706,643 | 12/1972 | Huba | 204/51 |
| 3,729,392 | 4/1973 | Bride | 204/51 |
| 3,833,485 | 9/1974 | Crowther et al. | 204/43 R |
| 3,954,574 | 5/1976 | Gyllenspetz et al. | 204/51 X |
| 4,054,494 | 10/1977 | Gyllenspetz et al. | 204/51 X |
| 4,107,004 | 8/1978 | Ward et al. | 204/51 |
| 4,234,396 | 11/1980 | Perakh et al. | 204/51 |

FOREIGN PATENT DOCUMENTS

| | | | |
|---|---|---|---|
| 2908846 | 9/1979 | Fed. Rep. of Germany | 204/51 |
| 7202364 | 8/1972 | Netherlands | 204/51 |
| 2086939 | 5/1982 | United Kingdom | 204/51 |

*Primary Examiner*—Andrew H. Metz
*Assistant Examiner*—Nam X. Nguyen
*Attorney, Agent, or Firm*—S. H. Parker; J. Matalon; R. E. Bright

[57] ABSTRACT

Chromium is electroplated from a bath which includes a trivalent chromium salt and chloride ions. Chlorine gas production at the anode is reduced through the incorporation in the plating bath of at least one salt having a nitrogen containing cation and at least one soluble salt yielding from about 0.001 mole per liter to about 0.01 mole per liter of bromide ion. The bath can further include sulfate ions, formate and boric acid or borate ions.

6 Claims, No Drawings

CONTROL OF ANODE GAS EVOLUTION IN TRIVALENT CHROMIUM PLATING BATH

This application is a continuation, of application Ser. No. 354,999, filed 03/05/82 now abandoned.

BACKGROUND OF THE INVENTION

1. Field of the Invention

This invention relates to processes for the electroplating of chromium from aqueous plating baths and more in particular it relates to the production of chromium electrodeposits from trivalent chromium plating baths. It also relates to novel trivalent chromium plating baths and further to a process for the suppression of chlorine gas and hexavalent chromium formation at the anodes during the operation of such baths.

2. Brief Description of the Prior Art

Chromium has been electrodeposited from trivalent plating baths primarily for decorative purposes. Generally it has not been utilized for functional chromium plating since the adhesion to the substrate has been poorer than the adhesion of chromium electroplates produced from hexavalent chromium plating baths.

The adhesion produced in trivalent chromium plating operations has been sufficient for decorative purposes and provides several advantages as compared to plating from hexavalent chromium plating baths. These include:

1. Higher coverage and freedom from burn at high current densities;
2. Good coverage at low current densities;
3. Reduced sensitivity to current breaks;
4. Fewer problems with waste disposal.

However, in addition to the aforementioned adhesion difficulties, there are several other problems attendant to the use of trivalent chromium plating baths. First, the deposit quality tends to deteriorate rapidly due to the formation of even a few parts per million of hexavalent chromium at the anode. The hexavalent chromium is very detrimental to the quality of the chromium electroplate since black streaks tend to be produced, thereby marring the appearance of the plate.

Further, conventional trivalent chromium plating bath compositions usually include sulfate ions as conductivity anions. Inasmuch as the generally utilized anodes are graphite anodes, oxygen is released during plating operations and can attack the anode causing erosion and the release of carbon particles into the bath. The resultant carbon particles tend to become included in the chromium electrodeposit thereby producing defects in the plate.

It has been suggested that the incorporation of salts containing a halogen anion in the bath will suppress the production of oxygen and thereby yield a better quality electrodeposit with longer bath life. For example, U.S. Pat. No. 3,833,485 suggests that the utilization of relatively high concentrations (0.05 M to 4 M) of either chloride ions or bromide ions in the bath will reduce anode erosion. The minimum useful concentrations are stated to be 0.1 M.

Generally, due to cost factors, chloride ion has been the halogen ion of choice. However, when utilizing effective levels of chloride ions in such plating baths, noxious chlorine gas is given off at the anode.

SUMMARY OF THE INVENTION

It has now been found that the use of the combination of low concentrations of bromide ion in conjunction with a nitrogen containing cation in chloride-containing trivalent chromium plating baths inhibits the evolution of chlorine, or other noxious gases, at the anode during plating operations.

In accordance with the present invention, chromium is electroplated from trivalent chromium plating baths which include a combination of a substantial amount of chloride ion, a nitrogen containing cation and from about 0.001 mole per liter to about 0.01 mole per liter of bromide ion, thereby suppressing the formation of chlorine gas and hexavalent chromium at the anode during the electroplating process. The optimum balance between cost and effectiveness is achieved in the range of 0.004 to 0.008 mole of bromide ion. The plating behavior of the bath has been found to be independent of the bromide concentration, and this formulation represents an appreciable cost saving over prior art.

DETAILED DESCRIPTION OF THE INVENTION

The trivalent chromium electroplating baths and processes of this invention are useful to provide decorative bright chromium electrodeposits. These electrodeposits may be produced on any type of metallic substrate material, but commercially, ferrous metal substrates are generally utilized. While not essential, it is standard commercial practice to first form an electroplate of bright nickel on the substrate material. Alternatively, bright electrodeposits of cobalt, nickel-iron alloy, cobalt-iron alloy, nickel-cobalt-iron alloy or copper could be utilized as the initial coating material for the substrate.

The nickel electrodeposit serves to provide a smooth surface onto which the chromium will be deposited. If this surface is not provided, it is believed to be unlikely that the thin chromium deposit would be sufficiently bright for consumer acceptance. The nickel electrodeposit also serves to provide corrosion resistance to the substrate material which is particularly valuable for outdoor usage of the manufactured item. The nickel electrodeposit is not to be confused with a nickel "strike" but is actually a substantial deposit of material. It is general commercial practice to provide a nickel deposit of about 0.1 mil to about 0.5 mil for indoor utilization and from about 1.0 mil to about 1.5 mils for outdoor utilization.

The trivalent chromium plating baths of this invention are conventional and, with the exception of the presence of the nitrogen-containing cation in conjunction with bromide ion. Similarly the process details follow normal commercial practice. Details of each may be found in the aforementioned U.S. Pat. No. 3,833,485, the relevant portions of which are incorporated herein by reference. The bath and process parameters are discussed hereinafter.

It should be noted that U.S. Pat. No. 3,833,485 discloses the use of a halogen, either chlorine or bromine to preclude oxygen liberation at the anode. By way of contrast, in the instant invention, chlorine and bromine are not optional alternatives, but rather are both essential additives. The chlorine is an essential conductivity anion and prevents hexavalent chromium formation at the anode. The presence of hexavalent chromium in concentrations as low as several parts per million can poison the bath. The bromine is critical in order to preclude chlorine generation at the carbon anode.

Generally any water soluble salt wherein chromium is present in the trivalent state may be utilized in the plating bath. Generally chromic chloride, chromic sulfate or a mixture thereof is utilized due to their low cost and ready availability.

We have found it convenient to utilize a material known as "chromium tanning salt". This is a commonly available form of chromic sulfate, the formula of which is often written $Cr(OH)SO_4.xH_2O$. However, it is believed to be actually a mixture of hydrated basic chromic sulfates, the exact composition of which will be dependent on the pH of the solution from which it was crystallized.

The chromium salt may be present over a relatively wide range of concentrations. Generally the chromium ion may be present in the range of from about 0.001 mole per liter to the limit of solubility of the chromium salt. The preferred range is from about 0.01 mole per liter to about 1.0 moles per liter. It is general commercial practice to utilize an initial chromium ion concentration at about the middle of the preferred range. This will ensure that the concentration does not drop during the plating process to a level so low that there may be some burn to the plated item. Further, it is commercially undesirable to have too high a chromium ion concentration as one can encounter waste disposal problems.

The baths will, of course, include substantial amounts of various salts to greatly increase the electrical conductivity of the bath. These salts and their constituent ions are generally considered to be salts other than the chromium salt. It is general practice to utilize from about 2 moles per liter to about 6 moles per liter of total conductivity salt. A commercially preferred range is from about 3.5M to about 5.5M. The terms conductivity cation and conductivity anion refer to the cations and anions respectively constituting the conductivity salt. The conductivity anion includes the anionic species which is introduced with the chromium cation.

Generally, but not necessarily, an important conductivity anion is sulfate ion. Sulfate ion is, of course, present whenever chromic sulfate is utilized as a source of chromium ions. When additional sulfate ion is deemed to be desirable, it may be introduced in any water soluble form. It may be most convenient to introduce it in the form of sulfuric acid, which may aid in pH adjustment, or as ammonium sulfate for reasons discussed below. In any event, the use of sulfate ion in the plating bath is not essential, but is particularly convenient. In its broadest range, the sulfate ion may comprise any amount up to about 90% (all percentages herein on a mole basis) of the total conductivity anion in the bath.

The presence of chloride ion is essential for satisfactory chromium plating from the instant trivalent chromium plating baths. Preferably it should be present in an amount of at least 5% of the total conductivity anion present in the plating bath. For certain uses, it may even constitute all of the conductivity anion present in the bath. Most preferably chloride ion is present in an amount which constitutes from about 10% to about 90% of the total conductivity anion present in the plating bath. Commercially, it is generally utilized at a concentration of 50% or higher.

The chloride ion may be introduced in any convenient water soluble form. It is conveniently introduced as hydrochloric acid, ammonium chloride, an alkali metal chloride or mixtures thereof. Of course, it may be also added as chromic chloride.

It is essential that a nitrogen containing cation be present in an amount equal to at least 5% of the total conductivity cation present in the bath. Preferably such cation is present in an amount equal to about 20% to about 90% of the total conductivity cation. It is most convenient to add the nitrogen containing cation to the bath in the form of an ammonium salt, such as the sulfate or chloride as described above. However, it may also be introduced in other forms, such as urea, hydrazine, hydroxylamine, or a variety of other amine materials which are generally added in the form of the sulfate or hydrochloride.

While it is believed that the nitrogen containing cation itself may be oxidized at the anode, this process is not sufficient to prevent the production of chlorine gas at the anode. However, it is believed that the nitrogen containing cation is able to reduce the bromine produced at the anode to regenerate bromide ion. Thus, while the nitrogen containing cation is consumed during the plating operations, the bromide ion will not be consumed. It is critical that the nitrogen containing cation be present if the bromide is to function at the very low levels utilized in this invention.

The bromide ion of this invention is preferably present in an amount ranging from about 0.001 mole per liter to about 0.01 mole per liter. Most preferably, to optimize its effect, it is present at a concentration of at least about 0.004 mole per liter. Commercially it will be generally utilized in amounts of about 0.0075 mole per liter to ensure that there is at least the optimum concentration present throughout the bath. If there is insufficient bromide ion present, one does not obtain a sufficiently high level of anode gas suppression to have any commercial viability. The utilization of too high a level of bromide ion provides no greater effect and is not economically viable from a commercial standpoint as bromide salts are generally quite expensive.

The bromide ion may be added conveniently in any manner similar to the addition of the chloride ion.

Generally, boric acid or a borate salt will also be included in the plating baths of this invention. The presence of the boric acid and/or borate serves to assist in pH control of the system. These materials are generally utilized in a total amount of about 0.1 to about 1 mole per liter, measured as boron.

Further, it will generally be advantageous to include a formate salt to the bath to improve the appearance of the plated product and provide greater covering power for the bath. Formate ions are generally utilized in the range of about 0.1 mole per liter to about 1.5 moles per liter. The formate may need to be replenished from time to time as it tends to be oxidized at the anode.

Acetate ions may also optionally be incorporated into the bath to assist in preventing the formation of hexavalent chromium.

Of course, other conventional additives may be utilized in the instant trivalent chromium plating baths.

The pH of the baths of this invention may be in the range of about 1 to 6 and preferably 2 to 5. Generally commercial baths will be operated at a pH of about 2.5 to about 4.5.

The temperature at which the plating process of this invention is carried out is not critical. Generally it is convenient to maintain temperatures in the range of from about 15° C. to about 50° C. and preferably from about 15° C. to about 30° C.

Generally the anodes utilized with trivalent plating processes are carbon or graphite or other anode materials having a low overvoltage. These are referred to as inert anodes. Anode materials having a high overvoltage, generally insoluble metallic anodes such as lead, tend to assist oxidation of trivalent chromium ions to the undesirable hexavalent state and are generally not used. Similarly, soluble chromium anodes are generally not utilized.

EXAMPLE 1

A plating bath was prepared by dissolving the following materials in water and diluting to one liter:

| Material | Amount | M |
|---|---|---|
| Chromium Tanning Salt | 196 g | 0.67 Cr |
| Ammonium Sulfate | 198 g | 1.5 $SO_4^{2-}$ |
| Ammonium Chloride | 54 g | 1.0 $NH_4Cl$ |
| Boric Acid | 3 g | 0.05 B |
| Dimethylformamide (DMF) | 80 g | 1.1 DMF |

The "chromium tanning salt" is chromic sulfate used in the tanning of leather, which is made by the reduction of sodium dichromate with sulfur dioxide. The material used has a "basicity" of 33%, basicity being a measure of the degree of replacement of sulfate ions by hydroxyl ions in the reduction product. The equilibrium pH of the bath after standing overnight was 3.4.

The bath prepared above was divided into two equal portions, Part A and Part B. To Part A was added 6 ml/l of a solution containing 100 g/l of potassium bromide, yielding a bromide concentration of 0.005 moles per liter in the bath. No bromide was added to Part B. The two solutions were placed in beakers equipped for magnetic stirring and circulatory cooling. Into each was inserted a carbon anode and a steel cathode, the anode to cathode area ratio being 2:1. All electrodes were totally submerged in the baths. The two cells were connected in series with a source of direct current, and a current of 1.2 amps (2.4 amps/liter in each bath) was passed for one hour. The current densities were about 50 amps/ft.$^2$ (ASF) on the anodes and about 100 ASF on the cathodes. The temperatures of both solutions were maintained between 25° and 27° C.

Initially, Part A gave off a very mild odor, while the odor from Part B was strong. After 5 minutes the odor from Part B somewhat moderated, but the odor from Part A remained much milder. For the remainder of the test period the intensity of odor from the two solutions varied, but that from Part A was always substantially lower than that from Part B.

EXAMPLE 2

One liter of a plating bath was prepared according to the following formulation:

| Material | g/l | M |
|---|---|---|
| Chromic Chloride Hexahydrate | 100 | 0.38 Cr |
| Ammonium Chloride | 150 | 2.8 $NH_4Cl$ |
| Potassium Sulfate | 75 | 0.43 $SO_4^{2-}$ |
| Acetic Acid | 10 | 0.17 $C_2H_3O_2^-$ |
| Sodium Formate | 50 | 0.74 $HCOO^-$ |
| Boric Acid | 50 | 0.81 B |
| Ferrous Ammonium Sulfate | 0.80 | 0.002 $Fe^{++}$ |
| Wetting Agent | 2 ml/l | — |

The wetting agent was an aqueous solution of a sodium alkyl sulfate. After equilibration the pH of the bath was adjusted to 3.3 with concentrated ammonium hydroxide.

The solution was divided into two equal portions, designated Bath A and Bath B. Two ml/l of a solution containing 49 g/l of ammonium bromide were added to Bath A, giving a bromide concentration of 0.001 mole per liter in Bath A. No bromide was added to Bath B.

The two solutions were electrolyzed in series under the same conditions as in Example 1, using the same type of apparatus.

Initially, both baths emitted an objectionable odor, but that from Bath A greatly diminished within one minute of starting the current. The two samples were electrolyzed under these same conditions for a total of four hours, for a total of 9.6 amp-hours/liter. The odor emitted by Bath B became and remained extremely strong, while that from Bath A was very slight.

EXAMPLE 3

A plating bath was formulated as follows:

| Material | g/l | M |
|---|---|---|
| Chromium Tanning Salt | 125 g | 0.43 Cr |
| Ammonium Chloride | 110 g | 2.06 $NH_4Cl$ |
| Potassium Chloride | 65 g | 0.87 KCl |
| Potassium Acetate | 16 g | 0.17 $C_2H_3O_2^-$ |
| Ammonium Formate | 44 g | 0.70 $CHO_2$ |
| Sodium Tetraborate | 43 g | 0.84 B |
| Ferric Chloride Hexahydrate | 0.34 g | 0.0012 $Fe^{++}$ |
| Hydrochloric Acid | 40 ml | 0.49 HCl |
| Wetting Agent | 2 ml | — |

The hydrochloric acid used was standard concentrated laboratory acid. The pH of the bath after equilibrating overnight was 3.4.

A sample of this bath was electrolyzed for 5 hours at 0.63 amp/liter, using a totally-submerged carbon anode at 50 ASF and a totally-submerged steel cathode at 100 ASF. The bath temperature was maintained between 17° and 22° C. by the use of circulatory cooling during this operation. A highly objectionable odor was produced continuously by the bath during plating.

An addition of solid potassium bromide amounting to 0.89 g/l was made to this bath, giving a bromide ion concentration of 0.0075 mole per liter. The solution was air-agitated for 20 minutes, and the total anode and cathode areas were doubled. The current was started again, this time at 1.25 amps/l, but still maintaining 50 ASF at the anode and 100 ASF at the cathode. It was found that the odor moderated to almost nothing within 4 minutes, and remained very slight after the passage of a total of 10 amp-hours/liter.

Comparison of plating tests run in the bath before and after the bromide ion addition and electrolysis showed that there was no effect on the cathode deposit, which was bright over a wide range of current density. The solution remained, at all times, free of hexavalent chromium, as shown by the plating results.

EXAMPLE 4

A well-worked sample of a bath originally formulated as in Example 3 was placed in a conventional (267 ml) Hull Cell. A carbon anode was inserted, magnetic stirring was applied, and a freshly nickel-plated brass panel cathode was plated with chromium at an average cathode current density of 55 ASF for ten minutes, the anode current density being about 45 ASF. The bath pH was 3.3. The temperature rose from 18° to 23° C. during the time of plating. In this case the anode was not totally submerged. A very strong odor was produced by the bath during plating.

To this sample 1.2 g/l of potassium bromide was added, giving a bromide ion concentration of 0.01 mole per liter in the bath. A freshly nickel-plated brass panel was then plated in this bath, under the same conditions as above, for ten minutes. The odor was immediately milder than it had been without the bromide, and could barely be detected after three minutes. At the end of ten minutes the current was increased so as to give a current density of about 55 ASF at the anode, and was maintained at that level for five minutes. The odor emitted by the bath did not increase.

Both panels plated above were bright in appearance over a current density range of about 800 to 18 ASF. The solution was shown by the plating results to be free of hexavalent chromium, both before and after the addition of KBr.

We claim:

1. An improved method for electroplating a high quality chromium deposit from a bath including a trivalent chromium salt and chloride ions which suppresses the production of chlorine gas at the anode and prevents the formation of hexavalent chromium ion even during an extended period of plating, comprising:

(a) including said bath a suppressor mixture of (i) an ammonium ion; and (ii) 0.004 to 0.008 mole per liter of bromide ion, (b) carrying out said plating to provide said high quality chromium deposit continuously during said extended period of plating without replenishing the bromide ion content.

2. An improved method according to claim 1 wherein the bromide ion concentration is 0.005 and the chromium ion concentration is 0.67 molar.

3. An improved method according to claim 1 wherein the bromide ion concentration is 0.0075 molar and the chromium ion concentration is 0.43 molar.

4. An improved electroplating bath for electroplating a high quality chromium deposit from a bath comprising a trivalent chromium salt and chloride ions which suppresses the production of chlorine gas at the anode and prevents the formation of hexavalent chromium ion even during an extended period of plating:

characterized by including therein a suppressor mixture of (1) an ammonium ion, and (2) 0.004 to 0.008 mole per liter of bromide ion, wherein said plating may be carried out to provide said high quality chromium deposit continuously during said extended period of plating without having to replenish the bromide ion content.

5. An improved electroplating bath according to claim 4 wherein the bromide ion concentration is 0.005 molar and the chromium ion concentration is 0.67 molar.

6. An improved bath according to claim 4 wherein the bromide ion concentration is 0.0075 molar and the chromium ion concentration is 0.43 molar.

* * * * *